US010262678B2

(12) United States Patent
Masuda et al.

(10) Patent No.: US 10,262,678 B2
(45) Date of Patent: Apr. 16, 2019

(54) SIGNAL PROCESSING SYSTEM, SIGNAL PROCESSING METHOD AND STORAGE MEDIUM

(71) Applicant: KABUSHIKI KAISHA TOSHIBA, Minato-ku, Tokyo (JP)

(72) Inventors: Taro Masuda, Kawasaki Kanagawa (JP); Toru Taniguchi, Yokohama Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 15/705,165

(22) Filed: Sep. 14, 2017

(65) Prior Publication Data

US 2018/0277140 A1 Sep. 27, 2018

(30) Foreign Application Priority Data

Mar. 21, 2017 (JP) ..... 2017-055096

(51) Int. Cl.

*H04R 1/40* (2006.01)
*H04R 3/00* (2006.01)
*G10L 21/0272* (2013.01)

(52) U.S. Cl.

CPC ..... *G10L 21/0272* (2013.01); *H04R 1/406* (2013.01); *H04R 3/005* (2013.01)

(58) Field of Classification Search

None

See application file for complete search history.

(56) References Cited

U.S. PATENT DOCUMENTS 9,093,078 B2 7/2015 Hacihabiboglu et al.
2008/0199152 A1* 8/2008 Namba ..... G11B 27/034 386/338

(Continued)

FOREIGN PATENT DOCUMENTS

JP 2007-215163 A 8/2007
JP 2008-039693 A 2/2008

(Continued)

OTHER PUBLICATIONS

Bello, J.P., et al., "A Tutorial on Onset Detection in Music Signals", IEEE Transactions on Speech and Audio Processing, vol. 13, No. 5, Sep. 2005, pp. 1035-1047.

(Continued)

*Primary Examiner* — Curtis A Kuntz
*Assistant Examiner* — Kenny H Truong
(74) *Attorney, Agent, or Firm* — Knobbe, Martens, Olson & Bear, LLP

(57) ABSTRACT

According to one embodiment, a signal processing system senses and receives generated signals of a plurality of signal sources, estimates a separation filter based on the received signals of the sensor for each frame, separates the received signals based on the filter to obtain separated signals, computes a directional characteristics distribution for each of the separated signals, obtains a cumulative distribution indicating the directional characteristics distribution for each of the separated signals output in a previous frame, computes a similarity of the cumulative distribution to the directional characteristics distribution of the separated signals of a current frame, and connects to a signal selected from the separated signals based on the similarity.

5 Claims, 4 Drawing Sheets

(56) References Cited

U.S. PATENT DOCUMENTS

| | | | | |
|---|---|---|---|---|
| 2014/0058736 | A1 | 2/2014 | Taniguchi et al. | |
| 2015/0341735 | A1* | 11/2015 | Kitazawa ..... | H04S 5/00 381/17 |
| 2017/0053662 | A1 | 2/2017 | Nakadai et al. | |

FOREIGN PATENT DOCUMENTS

| | | | |
|---|---|---|---|
| JP | 5117012 | B2 | 1/2013 |
| JP | 2014-041308 | A | 3/2014 |
| JP | 2014-048399 | A | 3/2014 |
| JP | 6005443 | B2 | 10/2016 |
| JP | 2017-040794 | A | 2/2017 |

OTHER PUBLICATIONS

Ono, N., et al., "Acoustic Signal Processing Based on Asynchronous and Distributed Microphone Array", The Journal of the Acoustical Society of Japan, vol. 70, No. 7, Jul. 2014, pp. 391-396.
Schmidt, R.O., "Multiple Emitter Location and Signal Parameter Estimation", IEEE Transactions on Antennas and Propagation, vol. AP-34, No. 3, Mar. 1986, pp. 276-280.
Swain, M.J., et al., "Color Indexing", International Journal of Computer Vision, vol. 7, No. 1, Nov. 1991, pp. 11-32.
U.S. Appl. No. 15/702,344, filed Sep. 12, 2017, Hirohata et al.

* cited by examiner

SIGNAL PROCESSING SYSTEM, SIGNAL PROCESSING METHOD AND STORAGE MEDIUM

CROSS-REFERENCE TO RELATED APPLICATIONS

This application is based upon and claims the benefit of priority from Japanese Patent Application No. 2017-055096, filed Mar. 21, 2017, the entire contents of which are incorporated herein by reference.

FIELD

Embodiments described herein relate generally to a processing system, a signal processing method, and a storage medium.

BACKGROUND

Conventionally, a multi-channel source separation technology of separating an acoustic signal of an arbitrary source from acoustic signals recorded from multi-channel sources has been employed in a signal processing system such as a conference system. In the multi-channel source separation technology, generally, an algorithm of comparing acoustic signals separated for the respective sources, increasing the degree of separation (independency and the like), based on the comparative result, and estimating the acoustic signal to be separated is used. At this time, a peak of directional characteristics is detected by preliminarily setting a threshold value depending on acoustic environment, and the acoustic signals of the sources separated based on the peak detection result are connected to the corresponding sources.

In actual employment, however, the acoustic signals of only one source do not continue being appropriately collected in one channel. This is because, for example, when two arbitrary signals are selected from the separated acoustic signals in a certain processing frame, the value of the objective function based on the degree of separation which compares the output signals is not varied even if channel numbers determined to respective output ends (often called channels) are replaced with each other. Actually, as a result of continuing use of the source separation system, changing a channel which continues outputting acoustic signals of a certain source to output acoustic signals of the other source occurs as a phenomenon. This phenomenon results from not failure in source separation, but remaining instability concerning the channel numbers output as mentioned above.

As mentioned above, the signal processing system based on the conventional multi-channel signal source separation technology has a problem that the generated signal of the only one signal source does not appropriately continue being collected to one channel, and the system is switched such that the generated signal of another signal source is output to the channel which continues outputting the generated signal of a certain signal source.

The embodiments have been accomplished in consideration of the above problem, and aims to provide a signal processing system, a signal processing method and a signal processing program which can continue outputting the generated signal derived from the same signal source to the same channel at any time, in multi-channel signal source separation.

DETAILED DESCRIPTION

Various embodiments will be described hereinafter with reference to the accompany drawings.

In general, according to one embodiment, there is provided a signal processing system which includes: sensor that senses an receives generated signals of a plurality of signal sources; a filter generator that estimates a separation filter based at least in part on the received signals of the sensor for each frame, separates the received signals based at least in part on the separation filter to obtain separated signals, and outputs the separated signals from a plurality of channels; a first computing system that computes a directional characteristics distribution for each of the separated signals of the plurality of channels based at least in part on the separation filter; a second computing system that obtains a cumulative distribution indicating the directional characteristics distribution for each of the separated signals of the plurality of channels output in a previous frame that is previous to a current frame in which the separation signals have been obtained, and that computes a similarity of the cumulative distribution to the directional characteristics distribution of the separated signals of the current frame; and a connector that connects to a signal selected from the separated signals of the plurality of channels and outputs the signal based at least in part on the similarity for each of the separated signals of the plurality of channels.

First Embodiment

Figure 1:
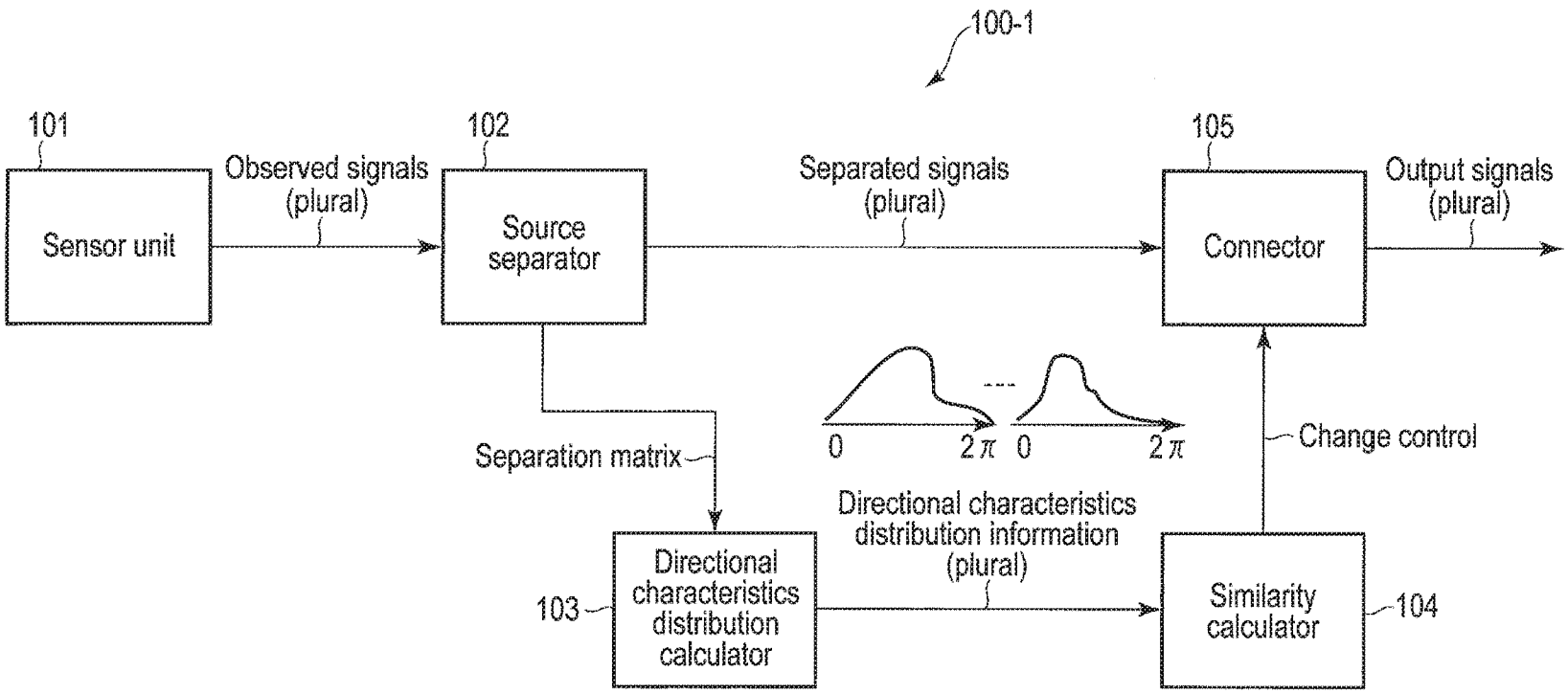
FIG. 1 is a block diagram showing a configuration of a signal processing system according to the first embodiment.

FIG. 1 is a block diagram showing a configuration of a signal processing system 100-1 according to the first embodiment. The signal processing system 100-1 comprises a sensor module 101, a source separator 102, a directional characteristics distribution computing unit 103, a similarity computing unit 104, and a coupler 105.

The sensor module 101 receives signals obtained by superposing observation signals observed by a plurality of sensors. The source separator 102 estimates a separation matrix serving as a filter which separates the observation signals from the signals received by the sensor module 101 for every frame unit based on a certain time, separates a plurality of signals from the received signals, based on the separation matrix, and outputs each separated signal. The directional characteristics distribution computing unit 103 computes a directional characteristics distribution of each separated signal from the separation matrix estimated by the source separator 102. The similarity computing unit 104 computes the similarity of a directional characteristics distribution of a current processing frame, and a cumulative distribution of the previously computed directional characteristics distribution. The coupler 105 couples the separation signal of each current processing frame with a previous output signal, based on the value of the similarity computed by the similarity computing unit 104.

The signal processing system 100-1 according to the first embodiment proposes the technology of estimating a direction of arrival of the source corresponding to each output signal, from a plurality of output signals separated by the source separation. For example, this technology multiplies a steering vector indirectly obtained from the separation matrix by a reference, steering vector obtained by assuming that the signal has arrived from a plurality of prepared directions, and determines the directions of arrival, based on the magnitude of the value. In this case, obtaining the direction of arrival robustly from the change of the acoustic environment is not necessarily easy.

Thus, in the signal processing system 100-1 according to the first embodiment, it does not ask for the directions of arrival of each separate signal directly, but the signal output by the previous frame using directional characteristics distribution and the separate signal in the present treatment frame are made to connect. Thus, an effect that the threshold adjustment according to change of acoustic environment is unnecessary can be obtained by using the directional characteristics distribution.

In the following embodiments, an example of observing the acoustic waves and processing the acoustic signals is mentioned, but the observed and processed are not limited to the acoustic signals but may be the other types of signals such as radio waves.

Concrete processing operations of the signal processing system according to the first embodiment will be explained.

The sensor module 101 comprises a sensor (for example, microphone) of a plurality of channels and each of the sensors observes the signal obtained by superposing the acoustic signals coming from all the sources which exist in a recording environment. The source separator 102 receives the observation signals received from the sensor module 101, separates the signals into the acoustic signals whose number is the same as the channel numbers of the sensors, and outputs the signals as separation signals. The output separation signals can be obtained by multiplying the observation signals by the separation matrix learned by using a criterion on which the degree of separation of the signals becomes high.

The directional distribution computing unit 103 computes the directional characteristics distribution of each separate signal by using the separation matrix obtained by the source separator 102. Since spatial characteristic information of each source is included in the separation matrix, "certainty factor on coming from the angle" at various angles of each separation signal can be computed by extracting the information. This certainty factor is called directional characteristics. Distribution acquired by obtaining the directional characteristics about a wide range angle is called directional characteristics distribution.

The similarity computing unit 104 computes similarity with the directional characteristics distribution separately computed from a plurality of previous separation signals by using the directional characteristics distribution obtained by the directional characteristics distribution computing unit 103. The directional characteristics distribution computed from the previous separation signals is called. "cumulative distribution". The cumulative distribution is computed based on the directional characteristics distribution of the separation signals more previous than the current treatment frame, and is held by the similarity computing unit 104. The similarity computing unit 104 sends a change control instruction to add the separate signal of the present treatment frame to the end of the previous separate signal to the coupler 105 from the similarity computation result.

In the coupler 105, the separation signals of the current processing frame are coupled with ends of the previous output signals, respectively, based on the change control instruction sent from the similarity computing unit 104.

Each of the above-explained processors (102 to 105) may be implemented by urging a computer device such as a central processing unit (CPU) to execute the program, i.e., as software, implemented by hardware such as an integrated circuit (IC), or implemented by using both software and hardware. The same matter will be applied to each of processors explained in the following embodiments.

Next, the present embodiment will be explained in more detail.

First, the sensor module 101 in FIG. 1 will be explained concretely.

The sensors provided in the sensor module 101 can be arranged at arbitrary positions, but attention should be paid so as to prevent one sensor from blocking a receiving port of another sensor. The number M of sensors is set to be two or more. When $M \leq 3$ in a case where the sources are not arranged on a certain straight line (i.e., the source coordinates are disposed two-dimensionally), two-dimensionally disposing the sensors not to be arranged on a straight line is suitable for the source separation at a sensors on the line segment which connects two sources is suitable.

In addition, the sensor module 101 is also assumed to comprise a function of converting the acoustic waves which are analogue quantity, into digital signals by A/D conversion, and assumed to handle digital signals sampled in a certain cycle in the following explanations. In the present embodiment, for example, a sampling frequency is set at 16 kHz so as to cover most of a zone where the sound exists, in consideration of application to processing of the audio signals, but may be varied in response to the purpose of use. In addition, the sampling between the sensors needs to be executed with the same clock in principle, but can be replaced with sampling in which the observation signals of the same clock are recovered, including, the processing for compensating for mismatch between the sensors by asynchronous sampling, similarly to, for example, Literature 1 ("Acoustic signal processing based on asynchronous and distributed microphone array," Nobutaka Ono, Shigeki Miyabe and Shoji Makino, Acoustical Society of Japan. Vol. 70, No. 7, p. 391-396, 2014).

Next, a concrete example of the source separator 102 in FIG. 1 will be explained.

It is as now that the acoustic source signal is represented by $S_{\omega,t}$ and the observation signal in the sensor module 101 is represented by $X_{\omega,t}$, at frequency ω and time t. It is considered that the source signal $S_{\omega,t}$ is a K-dimensional vector quantity and an independent source signal is included in each element. In contrast, the observation signal $X_{\omega,t}$ is an M-dimensional vector quantity (N is the number of sensors) and a value formed by superposing a plurality of acoustic waves is included in each of its elements. At this time, both of them are assumed to be modeled in the following linear expression.

$$X_{\omega,t}=A(\omega,t)S_{\omega,t} \tag{1}$$

where A(ω, t) is called a mixing matrix which is a matrix of dimension (K×M) and which indicates the spatial propagation of the acoustic signal.

The mixing matrix A(ω,t) is the quantity which does not depend on time, in a time-invariant system, but the quantity is generally a time-variable quantity since the mixing matrix actually is accompanied by variations in acoustic conditions such as change of positions of the sources and sensor arrays. In addition, X and S represent not signals of the time area, but signals subjected to transform in the frequency area such as short time Fourier transform (STFT) and wavelet transform. It should be therefore noted that they generally become complex variables. The present embodiment deals with STFT an example. In this case, a sufficiently long frame length needs to be set for an impulse response such that the above-mentioned relational expression of the observation signal and the source signal holds. For this reason, for example, the frame length is set at 4096 points and the shift length is set at 2048 points.

In the present embodiment, next, the separation matrix W (ω,t) (dimensions K×M) multiplied by the observation signal $X_{\omega,t}$ observed by the sensor to restore the original source signal is estimated. This estimation is expressed below.

$$S_{\omega,t} \approx W(\omega,t) X_{\omega,t} \tag{2}$$

symbol "≈" indicates that the quantity on the left side can be approximated by the quantity on the right side. The signal S separated for each processing frame can be obtained by the expression (2). As understood by comparing the expression (1) with the expression (2), the mixing matrix A(ω,t) and the separation matrix a W(ω,t) have a relationship of a mutually false inverse matrix (hereinafter called a false inverse matrix) as represented by the following expression.

$$A \approx W^{-1} \tag{3}$$

In the embodiments, each of the mixing matrix A(ω,t) and the separation matrix W(ω,t) is a square matrix, i.e., K=M, but can be replaced with an algorithm which obtains a false inverse matrix, and the like, i.e., an embodiment of K≠M can also be constituted. Since the mixing matrix A(ω,t) is considered as a time-varying quantity as explained above, the separation matrix W(ω,t) is also a time-variable quantity. If the signal output by the present embodiment in real time is to be used even in an environment which can be assumed to be a time-invariable system, the separation method of sequentially updating the separation matrix W(ω,t) at short time intervals is needed.

Thus, the present embodiment employs online independent vector analysis of Literature 2 (JP2014-41308A). However, this method may be replaced with a source separation algorithm capable of processing in the real time to obtain the separation filter which controls filtering based on spatial characteristic. In independent vector analysis, a separation method in which the separation matrix is updated to increase independence of signals separated from each other is employed. The advantage of using this separation method is that the source separation can be implemented without using any advance information, and procession of preliminarily measuring the position of the source and the impulse response in advance is unnecessary.

In the analysis using the independent vector, values recommended in all the literatures 2 as parameters (forgetting factor=0.96, shape parameter=1.0, which corresponds to approximating a source signal by Laplace distribution, and number of times of filter update repetition=2) but these values may be changed. For example, modification of approximating the source signal by time-varying Gaussian distribution, and the like are considered (and corresponds to shape parameter=0). The obtained separation matrix is used the directional characteristics distribution computing unit 103 (FIG. 1) of the subsequent stage.

Next, the directional characteristics distribution computing unit 103 in FIG. 1 will be explained concretely. First, the separation matrix W is converted into the mixing matrix A by expression (3). Each column vector $a_k=[a_{1k}, \ldots a_{Mk}]^T$ (1≤k≤K) of the mixing matrix A thus obtained is called a steering vector. T represents the transpose of the matrix the steering vector, m-th element amk (1≤k≤M) includes characteristics concerning the phase and attenuation of the amplitude in a signal emitted from the k-th source to the m-th sensor. For example, a ratio of absolute values between the elements of $a_k$ represents an amplitude ratio between sensors, of the signal emitted from the k-th source, and a difference of those phases corresponds to a phase difference between the sensors of acoustic waves. The position information of the source seen from the sensor can be therefore obtained based on the steering vector. The information based on the similarity of the reference steering vectors preliminarily obtained at various angles and the steering vector $a_k$ obtained from the separation matrix is used here.

Next, a method of computing the above-mentioned reference steering vector will be explained. A method of computing a steering vector in a case where a signal is approximated as a plane wave will be explained, but a steering vector computed when the signal is modeled as not only a plane wave but, for example, a spherical wave may be used. In addition, a method of computing the steering vector to which the only feature of the phase difference is reflected will be explained here, but the method is not limited to this and, for example, the steering vector may be computed in consideration of the amplitude difference.

Figure 2:
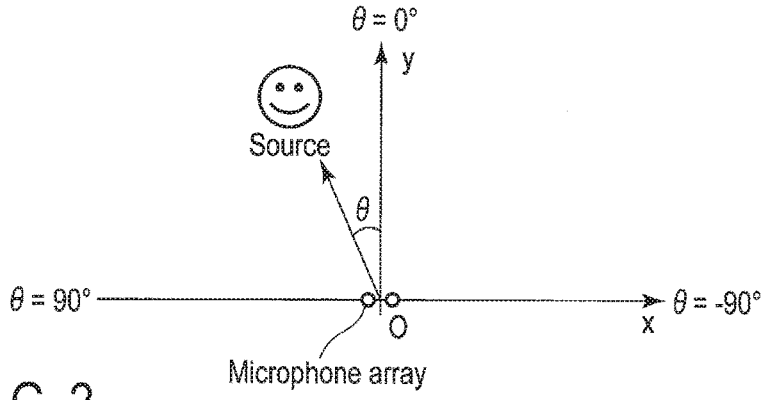
FIG. 2 is a conceptual illustration showing a coordinate system for explanation of processing of the signal processing system according to the first embodiment.

When a plane wave arrives at M sensors, the steering vector can be theoretically computed below in consideration of the only phase difference where an incoming azimuth of a certain signal is represented by θ.

$$a\theta=[e^{-j\omega T_1}, \ldots, e^{-j\omega T_M}]^T \tag{4}$$

where j represents an imaginary unit, ω represents a frequency, M represents the number of sensors, and T represents the transpose of the matrix. In addition, delay time tm in the m-th sensor (1≤m≤M) to the origin can be computed in the following manner.

$$\tau_m = -\frac{r_m^T e_\theta}{331.5 + 0.61t} \tag{5}$$

where t[° C.] represents a temperature of the air in implementation environment. In the present embodiment, t is fixed to 20° C. but is not limited to this and may be varied in accordance with the implementation environment. The denominator on the right side of expression (5) corresponds to the computation of obtaining the speed of sound [m/s] and, if the speed of sound can be preliminarily estimated by the other methods, the speed of sound may be replaced with the estimated value (example: estimating based on the atmospheric temperature measured with the thermometer and the like). $r_m^T$ and $e_\theta$ represent coordinates of m-th sensor (three-dimensional vector but may be two-dimensional when a specific plane alone is considered) and a unit vector (i.e., a vector having magnitude 1) indicating a specific direction θ, respectively. In the present embodiment, an x-y coordinate system as shown in FIG. 2 is considered as an example. In this case, the coordinate system is as follows.

$$e_\theta=[-\sin\theta, \cos\theta, 0] \tag{6}$$

Setting the coordinate system is not limited to this but can be set arbitrarily.

A mode of preparing the reference steering vector while assuming that the reference steering vector does not depend on the position coordinates of the sensors can also be considered. In this mode, since the sensor can be arranged at an arbitrary position, any arrangement can be implemented in a system comprising a plurality of sensors.

In a similarity computation explained below, a reference value of the delay time obtained by expression (5) needs to be preliminarily fixed. In the present embodiment, the delay time T1 in the sensor number m=1 is used as a reference value as represented below by expression (7).

$$a_\theta \leftarrow \frac{a_\theta}{e^{-j\omega\tau_1}} = [1, e^{-j\omega(\tau_2-\tau_1)}, \ldots, e^{-j\omega(\tau_M-\tau_1)}] \tag{7}$$

The symbol "←" has the meaning of "updating the value of the left side by using the value of the right side".

The above computation is executed about a plurality of angles θ. Since the object of the present embodiment is not to obtain the direction of arrival of each source, the resolution of the angle at the time of preparing the reference steering vector is set at Δθ=30° and their number is set at totally 12 within a range from 0° to 330°. Thus, if the source position change is minute, a robust distribution can be acquired at the position change. However, the angle resolution may be a finer or coarse resolution in accordance with the purpose of use or the condition of use.

K steering vectors ak computed from the actual separation matrix are considered as the feature quantity in which a plurality of frequency bands are collected. This is because, for example, in a case where the steering vectors concerning sound cannot be obtained with a good precision due to the influence of noise existing in a specific frequency band, if the steering vectors can be estimated with a good precision in the other frequency band, the influence of the noise can be reduced. This connection processing is not necessarily required but, when the similarity to be mentioned later is computed, the processing may be replaced with a method of selecting the similarity of a good reliability, of the similarities obtained for the respective frequencies.

The similarity S of the reference steering vector obtained in the above method and the steering vector a computed from the actual separation matrix is obtained based on expression (8). In the present embodiment, cosine similarity is adopted in similarity computation, but the similarity is not limited to this and, for example, the Euclidean distance between vectors may be obtained and the for example, not only may be found, and numerical values obtained by inverting relationship in size between the values may be defined as similarity.

$$S(0) - \frac{|a_\theta^H a|}{\|a_\theta\|\|a\|} \tag{8}$$

$H$: Hermitian transpose, $|\cdot|$: absolute value of complex number, $\|\cdot\|$: Euclidian norm Similarity S is a non-negative real number, the value of S certainly falls within a range of $0 \le S(\theta) \le 1$, and the value can easily be handled. When defining the similarity S, however, if its values are real numbers which can be determined in size, it does not need to be limited within the same values.

The value p obtained by collecting the above similarity about a plurality of angles θ is defined as directional characteristics distribution concerning the separate signal in the currently processed frame.

$$p=[S(\theta_1), \ldots, S(\theta_N)] \tag{9}$$

However, N is a total number of an angle index, and N=12 when considering the range from 0° to 330° at intervals of 30° as above-mentioned.

The directional characteristics distribution do not need to be obtained by multiplication of the steering vector and, for example, MUSIC spectrum and the like proposed in Literature 3 ("Multiple Emitter Location and Signal Parameter Estimation," Ralph O. Schmidt, IEEE Transactions on Antennas and Propagation, Vol. AP-34, No. 3, March 1986.) may substitute as the directional characteristics distribution. However, the present embodiment is aimed at a configuration which permits minute movement of the sound source, and it should be noted that the distribution in which a distribution value is distribution that the value of distribution changes abruptly due to a small difference in angle is undesirable.

The directional characteristics distribution obtained in the above-explained manner is used to estimate the direction of each separate signal in the subsequent stage in prior art. In contrast, in the present embodiment, the previous output signal and the separate signal of the current processing frame are connected without directly estimating the direction of each separate signal.

Next, the similarity computing unit 104 in FIG. 1 will be explained concretely. In this block, the similarity for solving a problem of optimal combination in which the separate signal in the current processing frame as connected with the previous output signal selected from a plurality of previous output signals, is computed based on the directional characteristics distribution information of each separate signal obtained by the directional characteristics distribution computing unit 103. In the present embodiment, a manner of selecting the combination by which the result of similarity computation becomes high is adopted but, for example, the distance may be used instead of the similarity and the problem may be replaced with a problem of selecting the combination by which the result of distance computation becomes small.

Next, a method of computing cumulative distribution of the previous separate signal based on the current processing frame will be explained. In the present embodiment, a forgetting factor by which the information on directional characteristics distribution estimated with the previous processing frame is forgotten in accordance with the time elapse is introduced in consideration of the movement of the source, a microphone array, and the like. In other words, the forgetting factor is estimated for a positive real value α (considered to be larger than 0 and smaller than 1) in the following manner.

$$p_{past}(T+1)=\alpha p_{past}(T)+(1-\alpha)p_{T+1} \tag{10}$$

The value α may be set as a fixed value or may be varied in time, based on information other than the directional characteristics distribution.

For example, an embodiment of assuming that the reliability of $p_{T+1}$ estimated by the current processing frame is high and making the value of α, based on likeness to voice (size of power, size of spectrum entropy, etc.) of the separate signal in the current processing frame, it the likeness to voice is high, can be considered. T is the number of cumulative frames (at this time, it should be noted that the number of the current processing frame is T+1), and $p_t=[p_{t,1}, \ldots p_{t,N}]$ is directional characteristics distribution at frame number t.

As a modified method of computing the cumulative distribution, methods of using the sum of the directional characteristics distribution p in all the processing frames from the processing start frame to the second current frame may be used or, for example, limiting the number of the previous frames to be considered, and the like may be modified. A method of obtaining cumulative distribution $p_{past}(T)$ in the present embodiment is represented in the following expression.

$$p_{past}(T) = \sum_{t=1}^{T} pt \tag{11}$$

In this case, since the distribution of T frames $p_t$ is accumulated, $p_{past}(T)=[p_{past,1}, \ldots, p_{past,N}]$ generally takes a value larger than $p_{T+1}$. In this status, since the scales of the values are different from each other, they are not suitable for similarity computation. Thus, the values are subjected to normalization as represented by the following expression.

$$p_{past}(T) \leftarrow \frac{p_{past}(T)}{\sum_{i=1}^{N} p_{past,i}} \tag{12}$$

$$p_{T+1} \leftarrow \frac{p_{T+1}}{\sum_{i=1}^{N} p_{T+1,i}} \tag{13}$$

This is the same expression of computation as that for normalizing the histogram (the sum of all the components becomes 1) but, for example, this may be replaced with the other normalization methods such as processing of normalizing Euclidean norm of both values to 1, normalization of subtracting the minimum component from each component and setting the minimum value to 0, and normalization of setting the average to 0 by subtracting the average value.

Next, a method of computing the similarity of the directional characteristics distribution computed from the current processing frame to the cumulative distribution computed from the previous processing frame will be explained. Similarity I between two distributions $p_1=[p_{11}, \ldots, p_{1N}]$ and $p_{past}=[p_{21}, \ldots, p_{2N}]$ can be computed by the following expression (14).

$$I = \sum_{i=1}^{N} \min(p_{1i}, p_{2i}) \tag{14}$$

The histogram crossing method disclosed in Literature 4 ("Color Indexing," Michael C. Swain, Dana H, Ballard, International Journal or Computer Vision, 7:1, 11-32, 1991.) is employed in the present embodiment, but may be replaced with any other methods of appropriately computing the similarity or distance between distributions, such as the chi-square distance and Bhattacharyya distance. For example, norm D in the following expression, and the like may be used as a distance scale, more simply.

$$D = \sum_{i=1}^{N} |p_{1i} - p_{2i}|^{l} \tag{15}$$

For example, the distance is known as distance L1 norm (Manhattan distance) in a case where l=1, and L2 norm (Euclidean distance) in a case where l=2.

The above-explained similarity is obtained for all combinations between the output signals and the separate signals, a combination by which the similarity becomes highest (total number of the combinations is K!(=K×(K−1)× . . . ×1) since K separated signals can be obtained) is selected, and the selection result is transmitted to the connector 105 as a change control instruction. All the combinations are considered by assuming that K is a small value (2, 3, or the like), but a problem arises that the total number of combinations is increased as K becomes large. If K is large or, for example, if a value of the similarity of a certain channel is lower than a threshold value which does not depend on acoustic environment, a more efficient algorithm of omitting computation of the similarity of the other channel and excluding the computation from the combination candidates and the like, may be introduced.

In the present embodiment, the directional characteristics distribution is used only to compute the above-mentioned cumulative distribution in the first processed frame and, in this case, the processing at a connector 105 which will be explained later may be omitted.

Finally, the coupler 105 in FIG. 1 will be explained concretely. In the coupler 105, the separate signal acquired in the source separator 102 is connected with an end of each of the previously output signals, based on the change control instruction sent from the similarity computing unit 104.

However, if the time signals obtained for each frame are connected, discontinuity may occurs, in a case where the signal in the frequency domain in which the connection processing is executed is used after subjected to inverse transform to a time domain by using, for example, inverse short term Fourier transform (ISTFT). Then, for example, processing which guarantees smoothing the output signal, and the like, by using a method such as an overlap-add method (partially overlapping a terminal part of a certain frame and a leading part of a following frame and expressing the output signal as their weighted sum), is added.

Second Embodiment

Figure 3:
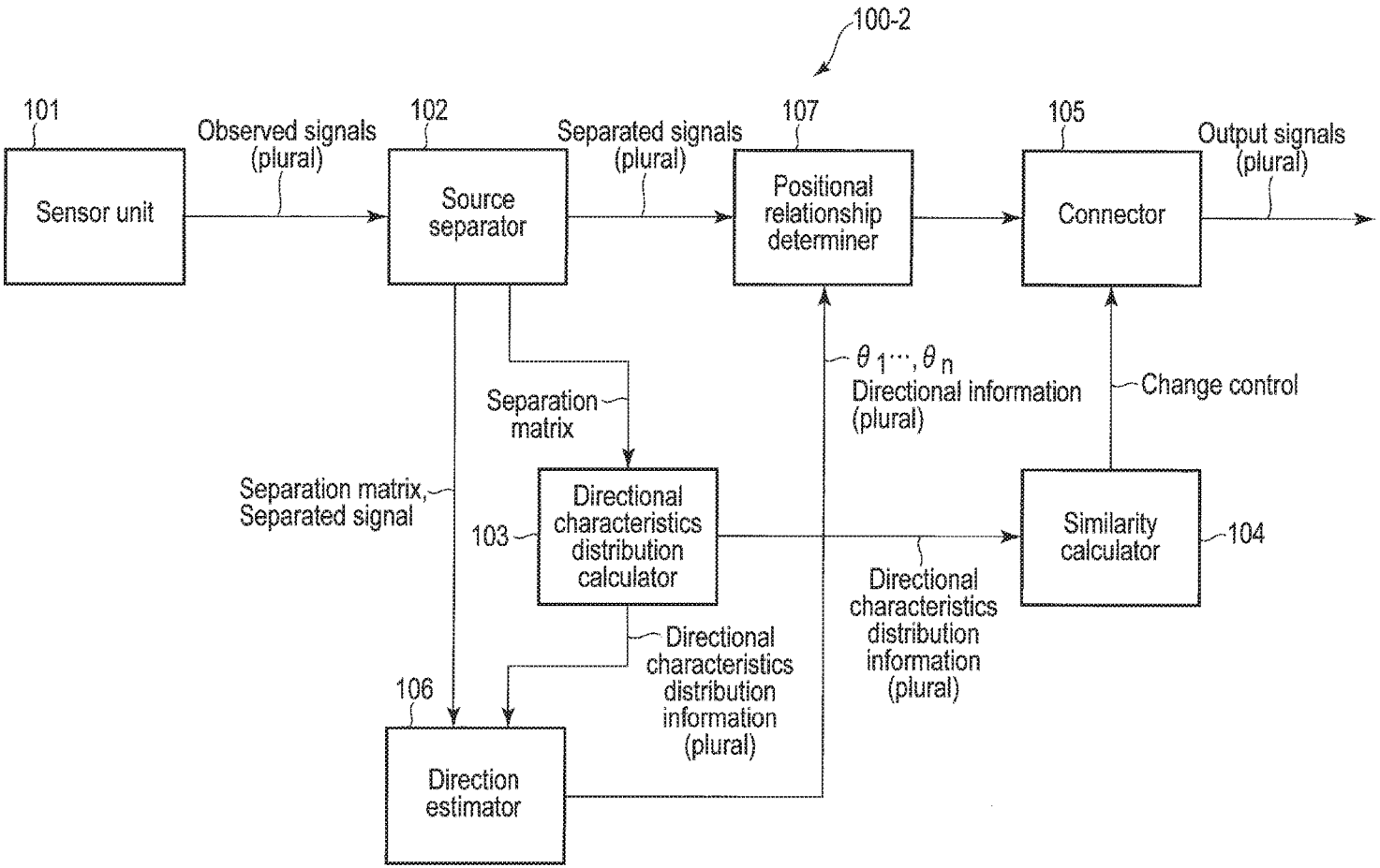
FIG. 3 is a block diagram showing a configuration of a signal processing system according to a second embodiment.

FIG. 3 is a block diagram showing a configuration of a signal processing system 100-2 according to the second embodiment. In FIG. 3, the same portions as those shown in FIG. 1 are denoted by the same reference numerals and duplicate explanations are omitted.

A signal processing system 100-2 of the present embodiment is configured by adding a function of adding a relative positional relationship to signals output in the first embodiment, and a direction estimator 106 and a positional relationship determiner 107 are added to a configuration of the first embodiment.

The direction estimation module 106 decides the spatial relationship about each separate signal based on the separation matrix called for in the sound source separator 102. A direction characteristics distribution corresponding to k-th separate signal is set in the following manner.

$$p_k=[p_{k,\theta_1}, \ldots, p_{k,\theta_m}, \ldots, p_{k,\theta_N}] \tag{16}$$

$\theta_n$ is an angle represented by an n-th reference steering vector ($1 \leq n \leq N$). The direction estimator 106, the rough arrival directions of the signal are estimated by the following formulas out of these directional characteristics distribution.

$$\hat{\theta}_k = \mathrm{argmax}_{\theta} p_k, \theta \quad (17)$$

$\hat{\theta}_k$: arrival direction

Expression (17) employs acquisition of the angle index at which $p_k$ becomes maximum, but is not limited to this and, for example, a change to obtain $\theta$ that maximizes the sum of $p_k$ of the angle index and an adjacent angle index, and the like may be added.

The information on the arrival directions obtained from the expression (17) is determined to each output signal in the spatial relationship determiner 107. It should be noted that an absolute value itself concerning the information on the determined angle is not necessarily used. For example, the resolution of the angle of the reference steering vector is set to be $\Delta\theta = 30°$ in the first embodiment, but the present embodiment does not aim at high-precision direction estimation. Instead, if only the information that the source is relatively located on the right side or left side can be acquired, the system is often sufficient in a scene of application (see the following cases). For this reason, in the present embodiment, the system is strictly distinguished from the system of estimating the angle by calling determination of the information on the arrival directions not "determination of position" but "determination of positional relationship".

In addition, the estimation of direction is not limited to the estimation of the angle in expression (17), but an example of considering the magnitude of the power of the separate signal can also be considered. For example, when the power of the separate signal to be noted is small, the certainty factor of the estimated angle is considered low, and use of an algorithm of substituting an estimated angle in a case where the power is higher in the previous output signal is considered.

For the above reason, the direction estimator 106 uses not only the directional characteristics distribution information acquired in the directional characteristics distribution computing unit 103, but the information of the separation matrix and the separate signal obtained by the source separator 102, as shown in FIG. 3.

Third Embodiment

Figure 4:
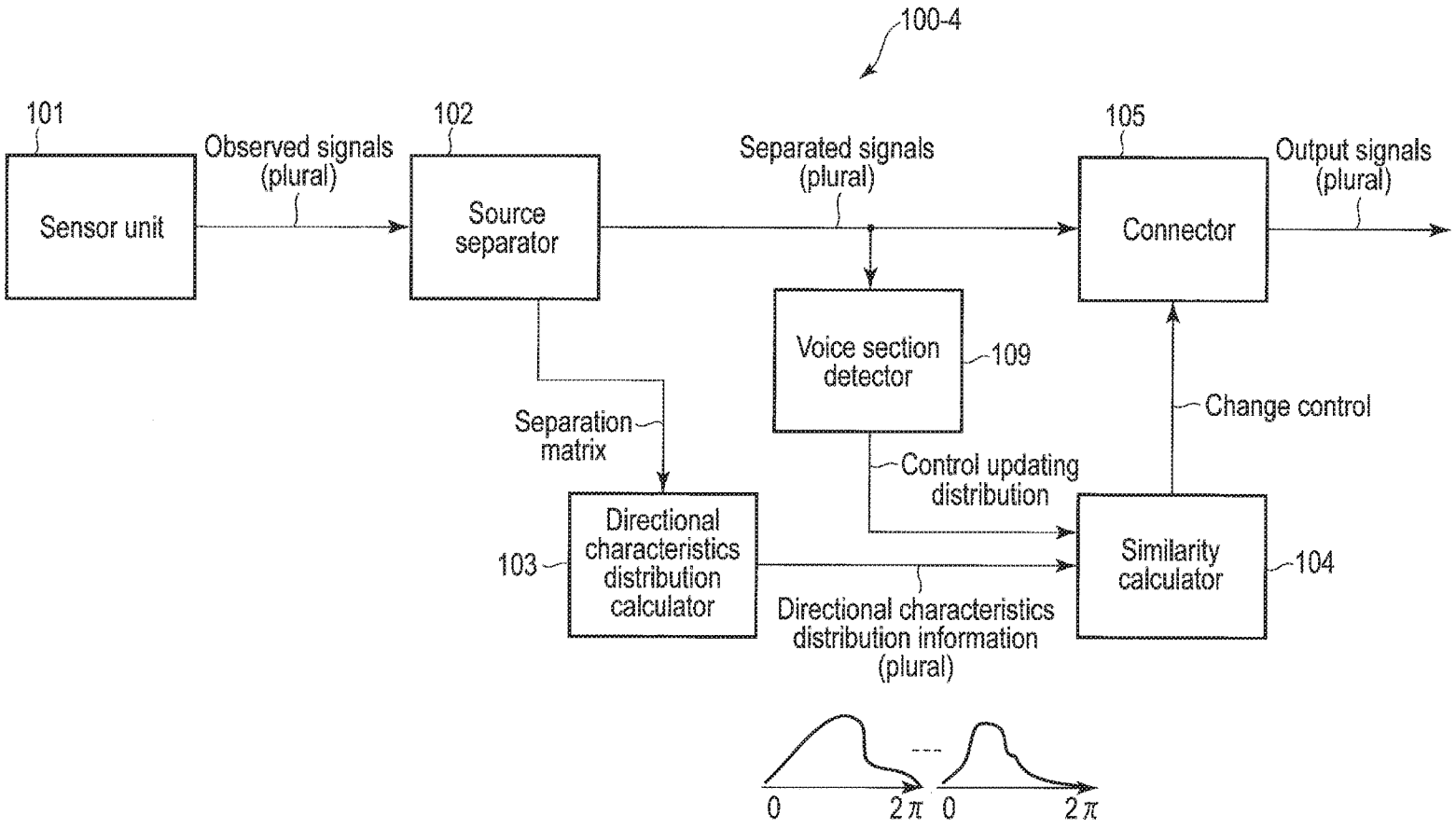
FIG. 4 is a block diagram showing a configuration of a signal processing system according to a third embodiment.

FIG. 4 is a block diagram showing a configuration of a signal processing system 100-3 according to the third embodiment. In FIG. 4, the same portions as those shown in FIG. 1 are denoted by the same reference numerals and duplicate explanations are omitted.

In the present embodiment, a cumulative distribution is prevented from being updated to an unintended distribution due to noise other than target voice, by introducing a manner of voice activity detection (VAD) to the first embodiment or its modified example. More specifically, as shown in FIG. 4, it is determined by a voice activity detection unit 109 whether each of a plurality of separated signals obtained by the source separator 102 is either a voice section or a non-voice section, the only cumulative distribution corresponding to the channel considered as the voice section is updated by the similarity computing unit 104, and updating the cumulative distribution corresponding to the other channels is omitted.

In the embodiment described here, the voice activity detection is introduced to collect the sound and, besides, a modified example of introducing processing (Literature 5 ("A Tutorial on Onset Detection in Music Signals," J. P. Bello; L. Daudet; S. Abdallah; C. Duxbury; M. Davies; M. B. Sandler, IEEE Transactions on Speech and Processing, Vol: 13, Issue: 5, September 2005.)) of detecting onset of notes to collect signals of musical instruments can also be employed.

(Use Case of Signal Processing System)

Actual examples of use of the above-explained signal processing system will be explained.

(Use Case 1: VoC (Voice of Customer) Collection System)

For example, the second embodiment is considered to be applied to a case in which a salesclerk executing over-the-counter sales or counter work holds a conversation with a customer. Speech can be recognized for each speaker by employing the embodiment, under a condition that these speakers are located in different directions seen from the sensor (difference in angle is desirably larger than the difference of the angle mentioned in the first embodiment), and a precondition that the speakers are identified based on the relative positions (for example, it is determined that a salesclerk is located on the right side and a customer is located on the left side). By integrating the voice recognition system using this, Voice of Customer (VoC) can be selectively collected, and collecting the language uttered in response to salesclerk's reception can help improve a service manual.

Since the output signal is used in the speech recognition in the subsequent stage, the distance between the sensor and the speaker is desirably in a range from several tens of cm to approximately 1 m so as not to lower the signal-to-noise ratio (SNR). The same matter is also applied to the other cases mentioned below when the voice recognition system is employed.

The speech recognition module may be built in the same device as the system of the present embodiment, but needs to be implemented in the other aspect when the computation resource is particularly restricted in the device of the present embodiment. In this case, an embodiment of transmitting the output sound to another device for speech recognition by communication and using the recognition result obtained by the device for speech recognition can also be considered by the configuration of the second embodiment, and the like.

Persons playing two types of roles, salesclerk and customer, are assumed here, but the number of speakers is not limited to totally two persons, one person each, but the embodiment can also be applied to a case where totally three or more speakers appear.

(Use Case 2: Simultaneous Multilingual Translation System)

For example, the second embodiment can be applied to a system of simultaneously translating a plurality of languages to support communications of the speakers who speak mutually different languages. Speech can be recognized and translated for each speaker by using the present embodiment, under the condition that the speakers are located in different directions seen from the sensor and the precondition that the languages are distinguished at relative positions (for example, a Japanese speaker is determined to be located on the right side and art English speaker is determined to be located on the left side). Communications can be made without knowledge on a counterpart's language, by realizing the above operations in as little delay time as possible.

(Use Case 3: Music Signal Separation System)

The present system can be applied to separation of an ensemble sound made by a plurality of musical instruments simultaneously emitting sounds. If the system is installed in a space in different directions for the respective musical instruments, a plurality of signals separated for the musical instruments can be simultaneously, according to the first or second embodiment or its modified example. This system is expected to have an effect that a conductor can check the performance of each musical instrument by listening to the output signals via a speaker, a headphone, or the like, and an unknown music can be transcribed for each musical instrument by connecting this system to an automatic transcription system on the subsequent stage.

Example 1

Figure 5:
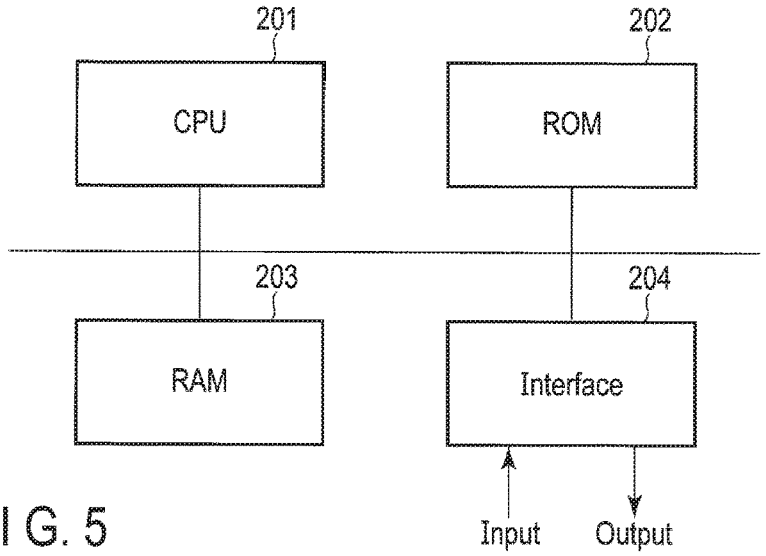
FIG. 5 is a block diagram showing a configuration of implementing the signal processing system according to the first to third embodiments by a computer device.

Next, hardware configuration of the signal processing system according to the first to third embodiments will be explained. As shown in FIG. 5, this configuration comprises a controller 201 such as a central processing unit (CPU), a program storage 202 such as a read only memory (ROM), a work storage 203 such as a random access memory (RAM), a bus 204 which connects the units, and an interface unit 205 which executes input of an observation signal from the sensor unit 101 and the output of the connected signals.

The program executed by the signal processing system according to the first to third embodiments may be configured to be preliminarily installed in the memories 202 such as ROM and provided, and recorded on a storage medium which can be read by a computer such as a CD-ROM as a file of a format which can be installed or executed, and provided as a computer product.

Example 2

Figure 6:
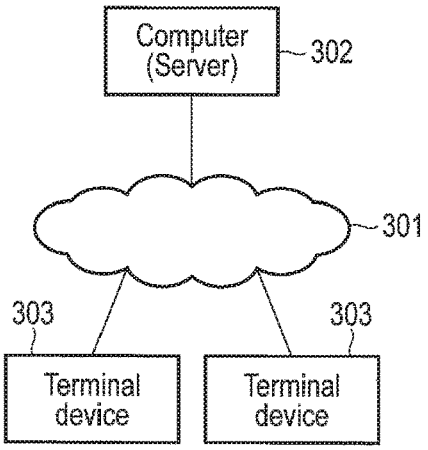
FIG. 6 is a block diagram showing a configuration of implementing the signal processing system according to the first to third embodiments by a network system.

Furthermore, as shown in FIG. 6, the system may be configured such that the program executed by the signal processing system according to the first to third embodiments is stored in a computer (server) 302 connected to the network 301 such as the Internet, and provided by being downloaded by a communication terminal 303 comprising a processing function of the signal processing system according to the first to third embodiments via the network. In addition, the system may be configured to provide or distribute the program over a network. Alternately, server/client configuration can be implemented to send the sensor output from the communication terminal 303 to the computer 302 via a network and urge the communication terminal 303 to receive the separated or connected output signal.

The program executed by the signal processing system according to the first to third embodiments can urge the computer to function as each of the units of the signal processing system. The computer can be executed by a CPU reading the program from a computer readable storage medium to a main memory unit.

The present invention is not limited to the embodiments described above, and the constituent elements of the invention can be modified in various ways without departing from the spirit and scope of the invention. Various aspects of the invention can also be extracted from any appropriate combination of constituent elements disclosed in the embodiments. For example, some of the constituent elements disclosed in the embodiments may be deleted. Furthermore, the constituent elements described in different embodiments may be arbitrarily combined.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and them equivalents are intended to cover such forms or modifications as would fall within the scope and spirit of the inventions.

What is claimed is:

1. A signal processing system, comprising:

sensors that detect signals from signal sources;

a memory that stores signals detected from the signal sources and output from-the sensors in units of frames; and a hardware processor that processes the signals stored in the memory by at least:

estimating a separation filter for separating the signals generated by the respective signal sources, based on the signals stored in the memory in units of frames, separating the signals generated by the respective signal sources in units of frames from the signals stored in the memory, based on the separation filter, outputting the signals separated in units of frames from channels, computing a directional characteristics distribution for each of the separated signals output from the channels in units of frames, obtaining a cumulative distribution indicating the directional characteristics distribution for each of the separated signals output in a frame previous to a current, from the channels, computing a similarity of the directional characteristics distribution for each of the separated signals in the current frame to the cumulative distribution for each of the separated signals in the previous frame, and connecting each of the separated signals in the current frame to one of the separated signals in the previous frame and outputting the signal, based on the similarity.

2. The signal processing system of claim 1, wherein the hardware processor is further configured to:

estimate an arrival direction from a corresponding signal source, of each of the separated signals of the channels, based on the separation filter; and assign information on a positional relationship based on the arrival direction to each of the separated signals of the channels.

3. The signal processing system of claim 1, wherein the hardware processor is further configured to:

determine a signal generation section and a signal non-generation section for each of the separated signals of the channels, and update the cumulative distribution corresponding to a channel considered as the determined signal generation section.

4. A signal processing method comprising:

detecting signals from signal sources;

storing the signals detected from the sensors in units of frames;

estimating a separation filter for separating the signals generated by the respective signal sources, based on the signals stored in the memory in units of frames;

separating the signals generated by the respective signal sources in units of frames from the signals stored in the memory, based on the separation filter;

outputting the signals separated in units of frames from channels;

computing a directional characteristics distribution for each of the separated signals output from the channels in units of frames;

obtaining a cumulative distribution indicating the directional characteristics distribution for each of the separated signals output in a frame previous to a current, from the channels;

computing a similarity of the directional characteristics distribution for each of the separated signals in the current frame to the cumulative distribution for each of the separated signals in the previous frame; and connecting each of the separated signals in the current frame to one of the separated signals in the previous frame and outputting the signal, based on the similarity.

5. A non-transitory computer-readable storage medium having stored thereon a computer program which is executable by a computer, the computer program comprising instructions capable of causing the computer to at least:

store signals from signal sources, which are detected by sensors, in a memory in units of frames;

estimate a separation filter for separating the signals generated by the respective signal sources, based on the signals stored in the memory in units of frames;

separate the signals generated by the respective signal sources in units of frames from the signals stored in the memory, based on the separation filter;

output the signals separated in units of frames from channels;

compute a directional characteristics distribution for each of the separated signals output from the channels in units of frames;

obtain a cumulative distribution indicating the directional characteristics distribution for each of the separated signals output in a frame previous to a current, from the channels;

compute a similarity of the directional characteristics distribution for each of the separated signals in the current frame to the cumulative distribution for each of the separated signals in the previous frame; and connect each of the separated signals in the current frame to one of the separated signals in the previous frame and outputting the signal, based on the similarity.

* * * * *